US008141172B2

(12) United States Patent
Furlong

(10) Patent No.: US 8,141,172 B2
(45) Date of Patent: Mar. 27, 2012

(54) ISOLATION GOWN WITH QUICK WAIST AND NECK CLOSURES

(75) Inventor: Peter M. Furlong, Green Oaks, IL (US)

(73) Assignee: Medline Industries, Inc., Mundelein, IL (US)

( * ) Notice: Subject to any disclaimer, the term of this patent is extended or adjusted under 35 U.S.C. 154(b) by 155 days.

(21) Appl. No.: 12/720,360

(22) Filed: Mar. 9, 2010

(65) Prior Publication Data

US 2011/0154554 A1 Jun. 30, 2011

Related U.S. Application Data

(60) Provisional application No. 61/290,223, filed on Dec. 27, 2009.

(51) Int. Cl.
*A41D 13/12* (2006.01)

(52) U.S. Cl. ..... 2/51; 2/52

(58) Field of Classification Search ..... 2/51, 114, 2/52, 48, 49.1, 50, 83, 77, 94, 129, 141.1, 2/243.1, 115; 24/16 PB, 68 BT; 128/873, 128/874, 869, 870
See application file for complete search history.

(56) References Cited

U.S. PATENT DOCUMENTS

| | | | | | |
|---|---|---|---|---|---|
| 371,353 | A | * | 10/1887 | Perry | 2/50 |
| 850,960 | A | * | 4/1907 | O'Connor | 2/319 |
| 1,506,332 | A | * | 8/1924 | Bloom | 2/48 |
| 1,980,436 | A | * | 11/1934 | Reagan | 2/48 |
| 2,172,162 | A | * | 9/1939 | Gillette | 2/49.1 |
| 2,430,941 | A | * | 11/1947 | Long | 2/49.1 |
| 2,653,324 | A | * | 9/1953 | McMahon | 2/49.2 |
| 2,673,347 | A | * | 3/1954 | Weiss | 2/114 |
| 3,130,462 | A | * | 4/1964 | Mitchell | 24/16 PB |
| 3,397,406 | A | * | 8/1968 | Leach | 2/96 |
| 3,399,406 | A | * | 9/1968 | Bradley | 2/114 |
| 3,451,062 | A | * | 6/1969 | Bradley | 2/114 |
| 3,696,443 | A | * | 10/1972 | Taylor | 2/114 |
| 3,803,640 | A | * | 4/1974 | Ericson | 2/114 |
| 3,952,373 | A | | 4/1976 | Noorily | |
| 4,017,909 | A | * | 4/1977 | Brandriff | 2/158 |
| 4,829,602 | A | * | 5/1989 | Harreld et al. | 2/51 |
| 4,951,318 | A | * | 8/1990 | Harreld et al. | 2/48 |
| 5,135,188 | A | | 8/1992 | Anderson et al. | |
| 5,136,758 | A | * | 8/1992 | Wilcox et al. | 24/431 |
| 5,377,387 | A | * | 1/1995 | Freed | 24/16 PB |
| 5,410,758 | A | * | 5/1995 | Dupont et al. | 2/51 |
| 5,414,867 | A | * | 5/1995 | Bowling et al. | 2/51 |
| 6,049,907 | A | * | 4/2000 | Palomo | 2/51 |
| 6,138,278 | A | | 10/2000 | Taylor | |
| 6,196,033 | B1 | * | 3/2001 | Dowdle | 70/16 |
| 7,549,179 | B1 | | 6/2009 | Saied | |
| 2006/0000002 | A1 | * | 1/2006 | Bergkvist | 2/49.1 |
| 2006/0117452 | A1 | * | 6/2006 | Ambrose | 2/51 |
| 2010/0299805 | A1 | * | 12/2010 | Graneto, III | 2/114 |

* cited by examiner

*Primary Examiner* — Amy Vanatta
(74) *Attorney, Agent, or Firm* — David S. Noskowicz; Philip H. Burrus, IV

(57) ABSTRACT

A medical gown (100) is configured for quick donning and removal. A neck closure includes an insertion strap (109) and a fastening strap (110). The insertion strap (109) can be pre-configured with at least a portion thereof inserted into a fastening head (111) of the fastening strap (110). A wearer (700) passes the head through a neck opening (105) and cinches the neck closure by pulling the insertion strap (109) through the fastening head (111). A coupling tab (108), where provided, can then be wrapped about the wearer's torso and adhesively affixed to the medical gown (100). The medical gown (100) can be made from a non-woven material that is configured to be easily tearable by the wearer (700). Accordingly, the wearer (700) can remove the medical gown (100) by tearing the non-woven material.

18 Claims, 6 Drawing Sheets

ISOLATION GOWN WITH QUICK WAIST AND NECK CLOSURES

CROSS REFERENCE TO PRIOR APPLICATIONS

This application claims priority and benefit under 35 U.S.C. §119(e) from U.S. Provisional Application No. 61/290,223, filed Dec. 27, 2009.

BACKGROUND

1. Technical Field

This invention relates generally to medical gowns, and more particularly to a medical gown having a quick close neck closure.

2. Background Art

Medical professionals are called on to prevent cross contamination when treating patients. For example, where a doctor is treating two patients, and one patient has a communicable disease, the doctor must take care not to function as a vector for the disease when visiting other patients. When the doctor visits multiple patients in succession, the doctor must ensure that microorganisms or pathogens are not carried from one patient to the other.

This is frequently accomplished by donning a medical gown, which is sometimes referred to as an "isolation gown." A medical service provider treating a sick patient will sometimes don the isolation gown prior to entering that patient's room. When exiting the room, the medical professional will remove the gown, thereby ensuring that no microorganisms or pathogens from the patient have attached to the medical service provider's clothes.

One problem associated with prior art isolation gowns, is that they are too time-consuming to put on and take off. A busy medical services provider may treat hundreds of patients during a given day. Prior art isolation gowns that require excessive time to put on or take off can reduce the number of patients they can be seen in a given day. Another problem associated prior art isolation gowns is that they are too complicated. Some include drawstrings and other fastening mechanisms that are cumbersome to employ.

There is thus a need for improved medical gown that is quick and simple to put on and take off.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
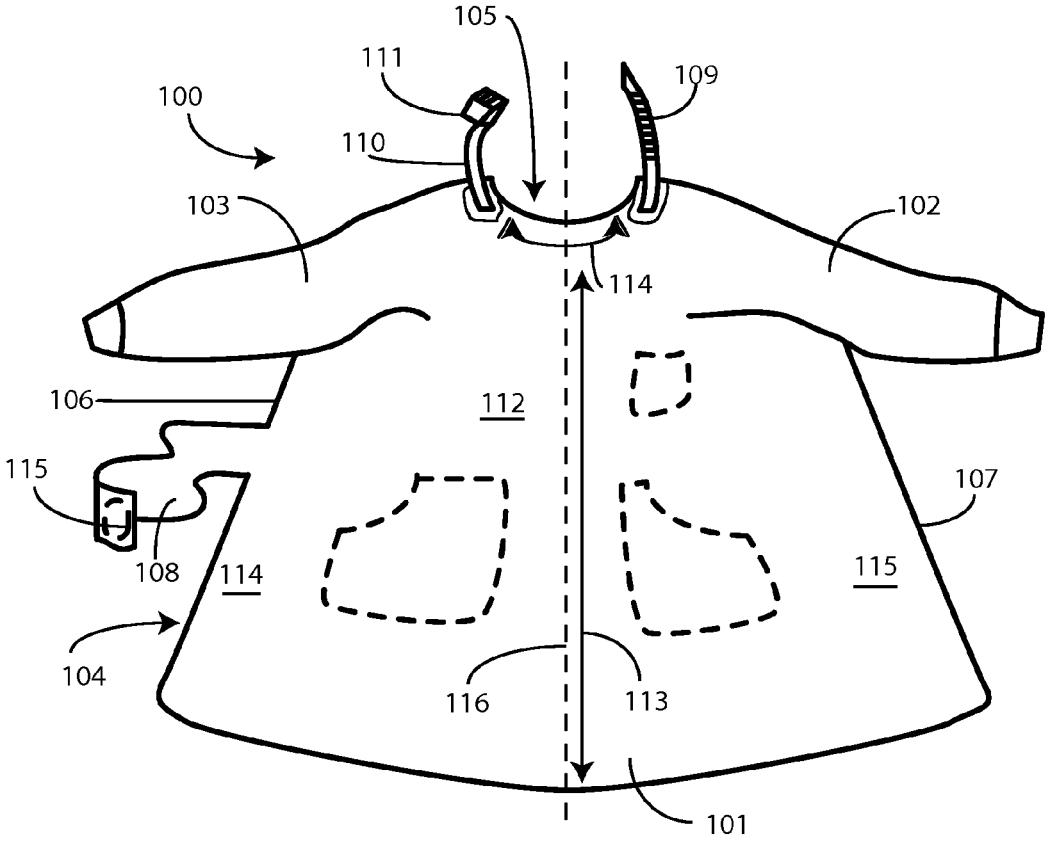
FIG. 1 illustrates a front view of a medical gown in accordance with embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE INVENTION

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Embodiments of the present invention provide a medical gown, which can be used in practice as an isolation gown in one embodiment. Additionally, the medical gowns of the present invention can be used as general purpose medical gowns as well. Embodiments of the invention are capable of being quickly donned by a medical services provider, and are even more quickly removed. In one embodiment, for example, the gown is made from a non-woven material that can easily be torn by the wearer.

Turning now to FIG. 1, illustrated therein is one medical gown 100 in accordance with embodiments of the invention. A body covering portion 101 is configured to wrap about the torso of a wearer. In one embodiment, the medical gown 100 is manufactured from a non-woven fabric. The non-woven fabric can be a disposable material, and optionally can include and water resistant lining that prevents the passage of fluids through the body covering portion 101. In one embodiment, the length 113 of the medical gown 100 is configured to run from a wearer's shoulder to below their knee.

In one embodiment, the non-woven fabric is configured so as to be tearable by a wearer. For example, to non-woven fabric may have a tensile strength of between four and ten pounds. Thus, if aware were to grasp opposing sides of a section of the non-woven fabric, and then pull with a force of between four and ten pounds, the fabric would tear. As will be shown below, and one embodiment all where removes the gown by tearing the non-woven fabric. Accordingly, a non-woven fabric that is easily tearable by a wide range of wearers, e.g., male and female wearers, may be selected for construction of the medical gown 100 in accordance with such an embodiment.

A first sleeve 102 and a second sleeve 103 extend distally from the body covering portion 101. The first sleeve 102 and the second sleeve 103 are configured to receive wearer's arms when the medical down 100 is donned. In the illustrated embodiment of FIG. 1, the first sleeve 102 and second sleeve 103 are illustrated as long sleeves. However, it will be clear to those of ordinary skill in the art having the benefit of disclosure that embodiments of the invention are not so limited. Medical gowns in accordance with embodiments of the invention may equally be configured with short sleeves or no sleeves has a particular application may warrant.

As shown in FIG. 1, medical gown 100 may optionally include pockets 117 or other surface features. A front portion 112 of the medical gown 100 is configured to be placed against the front of the torso. The body covering portion 101 then wraps around and terminates at a body opening 104 having a first side 106 and a second side 108.

In the illustrative embodiment of FIG. 1, the body opening 104 is configured as a slit that runs the length of the body covering portion 101, up the back of the medical gown 100, terminating at a neck opening 105. The first side 106 and second side 107 of the body opening 104 are configured to permit the wearer to don the medical gown 100 by wrapping the first side 106 and second side 107 about the wearer's torso.

In one embodiment, the gown is retained about the neck of a wearer by a pair of interlocking straps. An insertion strap 109 is coupled to and extends from one side of the body opening 104. In the illustrative embodiment of FIG. 1, the insertion strap 109 is disposed adjacent to the neck opening 105 and extends distally from the neck opening 105. Similarly, of fastening strap 110 is coupled to an opposite side of the neck opening 105 and extends distally from the neck opening 105. The fastening strap 110 includes a fastening head 111 that is configured to engage the insertion strap 109 and retain the medical gown 100 on the wearer by passing about the wearer's neck. The fastening head 111 is configured to prevent the insertion strap 109, once inserted into the fastening head 111, from being withdrawn from the fastening head 111.

The insertion strap 109 and fastening strap 110 of this embodiment of the invention do not include adhesives for coupling together, but rather rely on mechanical fastening means, as will be described below. By avoiding the use of adhesives to close the neck opening 105, embodiments of the present invention offer advantages over prior art gowns in that a wearer's hair will not be inadvertently caught in the adhesive.

As shown in the illustrative embodiment of FIG. 1, the insertion strap 109 and the fastening strap 110 are separate components, and do not join in the front portion of the neck opening 105. The two straps are configured as separate components in one embodiment of the invention for several reasons. First, as will be shown below, separating the straps allows the gown to be torn by a wearer for removal. Second, separating the straps ensures that the straps do not tighten excessively around the wearer's neck.

Illustrating by way of example, in the illustrative embodiment of FIG. 1, the insertion strap 109 is separated from the fastening strap 110 along the front portion 112 of the medical gown 100 by a section or perimeter portion 114 of the non-woven material. In one embodiment, this perimeter portion 114 is configured to be torn by a wearer when the wearer wishes to remove the medical gown 100. In addition to facilitating quick and easy removal, the tearable perimeter portion 114 serves as a safety measure by preventing the insertion strap 109 and fastening strap 110 from cinching too tightly about the wearer's neck.

In one embodiment, one of the first side 106 or the second side 107 includes a coupling tab 108 that extends therefrom. The coupling tab 108 is configured to wrap about the wearer and span the body opening 104. In one embodiment, the coupling tab 108 includes an adhesive 115 that is configured to attach to the non-woven material on the other side of the body opening.

Where a coupling tab 108 is included, once the wearer dons the medical gown, the coupling tab 108 can be wrapped about the torso, such as about the wearer's waist, and adhesively affixed to the other side. When the wearer wishes to remove the medical gown 100, this can be accomplished in a variety of ways. In a first embodiment, the coupling tab 108 can be manufactured from the same non-woven material as the body covering portion 101. In such an embodiment, the wearer may simply tear the coupling tab 108 to remove the medical gown 100.

In another embodiment, the adhesive 115 is a selectively detachable adhesive that forms a non-permanent bond with the non-woven material such that the wearer can selectively detach the coupling tab 108 from the non-woven material. In this embodiment, when the wearer wants to remove the medical gown, the wearer simply pulls the coupling tab 108 from the opposite side of the body opening 104 to release the adhesive bond.

In another embodiment, where the front portion 112 of the body covering portion 101 is configured to be easily tearable, the wearer simply begins tearing the front portion 112 at the neck perimeter portion 114 and continues tearing down a tear line 116 along the front portion 112 until either the front portion 112 is completely torn or is sufficiently torn for the wearer to step out of the now enlarged neck opening 105.

Figure 2:
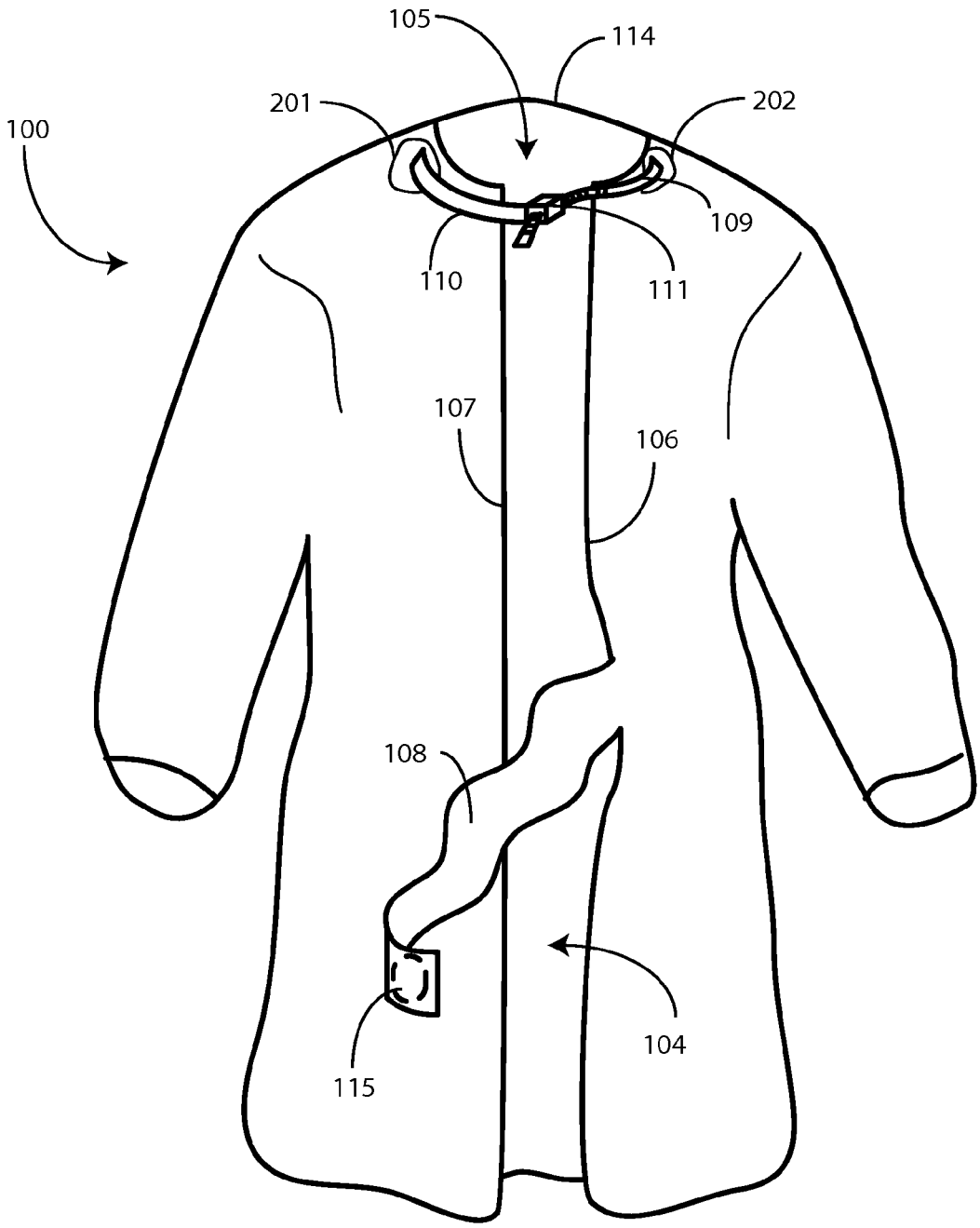
FIG. 2 illustrates a rear view of a medical gown in accordance with embodiments of the invention.

Turning now to FIG. 2, illustrated therein is a rear view of a medical gown 100 configured in accordance with embodiments of the invention. From this view, the body opening 104 and neck opening 105 can more readily be seen. Additionally, the coupling tab 108 and adhesive 115 may be seen extending from the first side 106 of the body opening.

As shown in FIG. 2, one coupling tab 108 is disposed approximately waist-high so as to span the body opening 104 to the second side 107 about the waist of the wearer. It will be clear to those of ordinary skill in the art having the benefit of this disclosure, however, other configurations are possible. For example, multiple coupling tabs could be employed. Additionally, the coupling tabs may be disposed at other locations along the body opening 104, such as shoulder-high or mid-back.

In the illustrative embodiment of FIG. 2, the insertion strap 109 and fastening strap 110 have been preconfigured in an attached mode, with at least a portion of the insertion strap 109 inserted into the fastening head 111 of the fastening strap 110. This configuration can be prepared by the manufacturer prior to shipping the medical gown 100. Alternatively, the configuration can be prepared by, for example, hospital staff prior to use by a doctor or nurse.

As it takes time to insert the insertion strap 109 into the fastening head 111, this preconfiguration allows the wearer to simply slip the preconfigured insertion strap 109 and fastening strap 110 about the back of the head when donning the medical gown 100. Said differently, the wearer may initially slip their head into the neck opening 104 with the perimeter portion 114 of the neck opening 105 passing about the front of the head and the preconfigured insertion strap and fastening strap 110 passing about the back of the head. In doing so, the wearer would need only to cinch the insertion strap 109 by pulling it further through the fastening head 111 to retain the medical gown about the body. Where the coupling tab 108 is included, the wearer could then wrap the coupling tab 108 about the back and affix the adhesive 115 to the non-woven material on the opposite side of the body opening 104.

In one embodiment, the insertion strap 109 and fastening strap 110 can be configured to be selectively detachable from the medical gown 100. For example, rather than tearing the non-woven material to remove the medical gown 100, a wearer may prefer to tear the insertion strap 109 and the fastening strap 110 from the gown, thereby releasing the neck opening 104 from the wearer's neck.

In such an embodiment, the insertion strap 109 and fastening strap may be detachably coupled to the medical gown 100, such as by a non-permanent adhesive. In the illustrative embodiment of FIG. 2, a first adhesive patch 201 adheres the insertion strap 109 to the medical gown 100, while a second adhesive patch 202 adheres the fastening strap 110 to the medical gown 100. When a wearer wants to remove the medical gown 100, the wearer may grasp the perimeter portion 114 of the neck opening 105 and pull, thereby separating the insertion strap 109, the fastening strap 110, or both, from the material comprising the medical gown 100.

Figure 3:
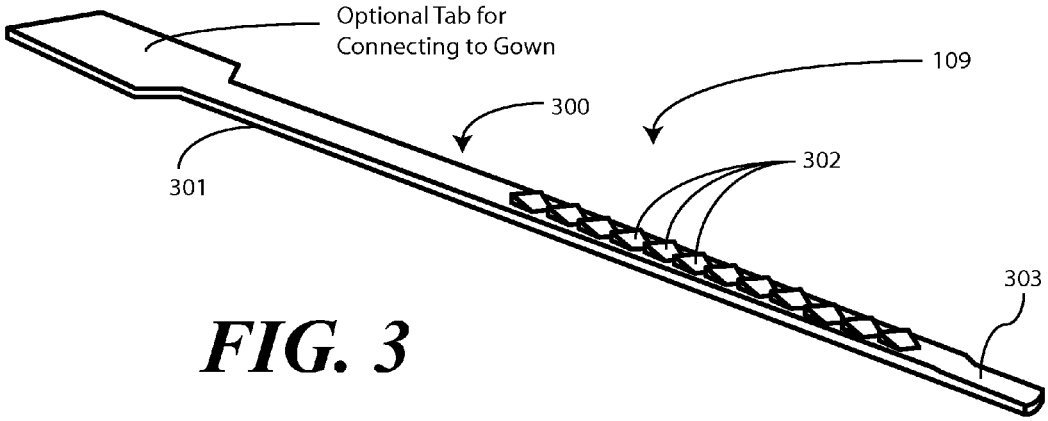
FIG. 3 illustrates one insertion strap in accordance with embodiments of the invention.

Turning now to FIG. 3, illustrated therein is one embodiment of an insertion strap 109 in accordance with embodiments of the invention. In one embodiment, the insertion strap 109 comprises a body portion 300 having faces on either side thereof, a gown coupling section 301, a fastener engagement section comprising a plurality of teeth 302, and an insertion tip 303. In one embodiment, the body portion 300 is constructed from a thermoplastic material by way of an injection molding process.

The body portion 300 extends from the gown coupling section 301 to the insertion tip 303. Each of the plurality of teeth 302, which in one embodiment are disposed along one face of the body portion 300 between the insertion tip 303 and the gown coupling section 301, includes an inclined leading edge and a trailing edge that is substantially normal to the body portion 300. The plurality of teeth 302 thereby forms a series of ramps running from the insertion tip 303 to the gown coupling section 301. The face opposite the plurality of teeth 302, in one embodiment, is substantially smooth.

The insertion strap 109 of FIG. 3 is but one illustrative embodiment. It will be clear to those of ordinary skill in the art having the benefit of this disclosure that modifications can be made to the insertion strap 109 without departing from the spirit and scope of the invention. For example, the plurality of teeth can extend across the insertion tip 303. Further, the plurality of teeth can extend across the gown coupling section 301. In one embodiment, rather than using a plurality of teeth 302, a plurality of indentations can be used. Additionally, a plurality of teeth can be placed on both faces of the body member 300.

Figure 4:
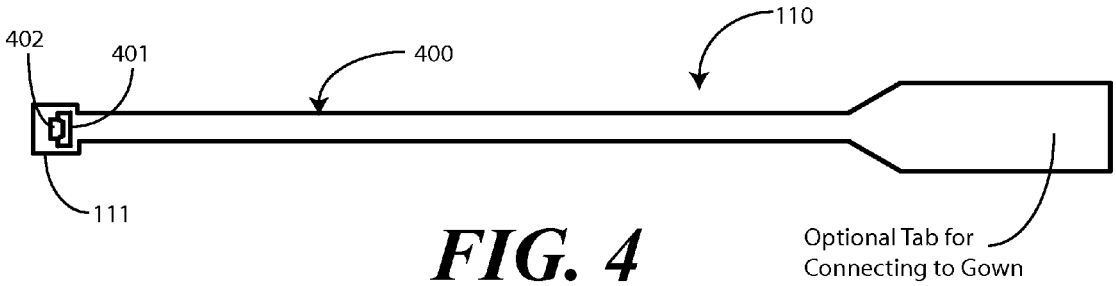
FIG. 4 illustrates one fastening strap in accordance with embodiments of the invention.

Turning now to FIG. 4, illustrated therein is one embodiment of a fastening strap 110 having a fastening head 111 in accordance with embodiments of the invention. As with the insertion strap (109) of FIG. 3, the fastening strap 110 includes a body portion 400 having opposing faces and running from a gown coupling portion 401 to the fastening head 111. In one embodiment, the body portion 400 is manufactured from a thermoplastic material in an injection molding process.

The fastening head 111 has an aperture 401 through which the insertion strap (109) can pass. Within the aperture 401 is a latch 402 that is configured to engage one or more of the plurality of teeth (302) so as to prevent the insertion strap (109), once inserted into the fastening head 111, from being withdrawn from the fastening head 111. In one embodiment, the latch 402 is configured as a cantilever arm that passes along the inclined leading edge of each tooth and than "latches" by snapping down along the substantially normal trailing edge of each tooth. As such, the latch 402 facilitates a one-way, cinchable but not releasable, fastener. Thus, the fastening strap 110 and insertion strap (109) can be tightened about the neck of the wearer, but will not inadvertently release. While the latch 402 is configured as a cantilever beam in the illustrative embodiment of FIG. 4, it will be clear to those of ordinary skill in the art having the benefit of this disclosure that embodiments of the invention are not so limited. For example, the latch 402 could be configured with complementary teeth to those disposed along the insertion strap (109) as well.

Figure 5:
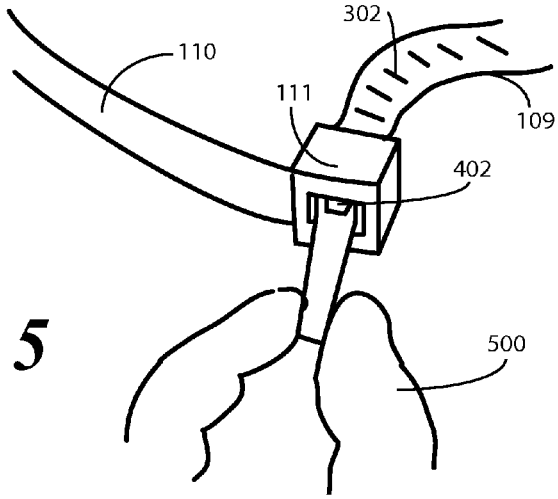
FIG. 5 illustrates a wearer cinching a neck closure in accordance with embodiments of the invention by pulling and an insertion strap through a fastening head in accordance with embodiments of the invention.

Turning now to FIG. 5, illustrated therein is a wearer 500 cinching the insertion strap 109 with the fastening strap 110. As shown in FIG. 5, the wearer cinches the two straps by pulling the insertion strap 109 through the fastening head 111 of the fastening strap 110. In FIG. 5, the fastening head 111 is shown in a sectional view. When the wearer 500 pulls the insertion strap 109, the latch 402 passes over each of the plurality of teeth 302. The wearer 500 can thus tighten the straps, while being confident the latch 402 will not disengage, thereby potentially exposing the wearer's clothing to contaminants, microorganisms, germs, or other pathogens.

Figure 6:
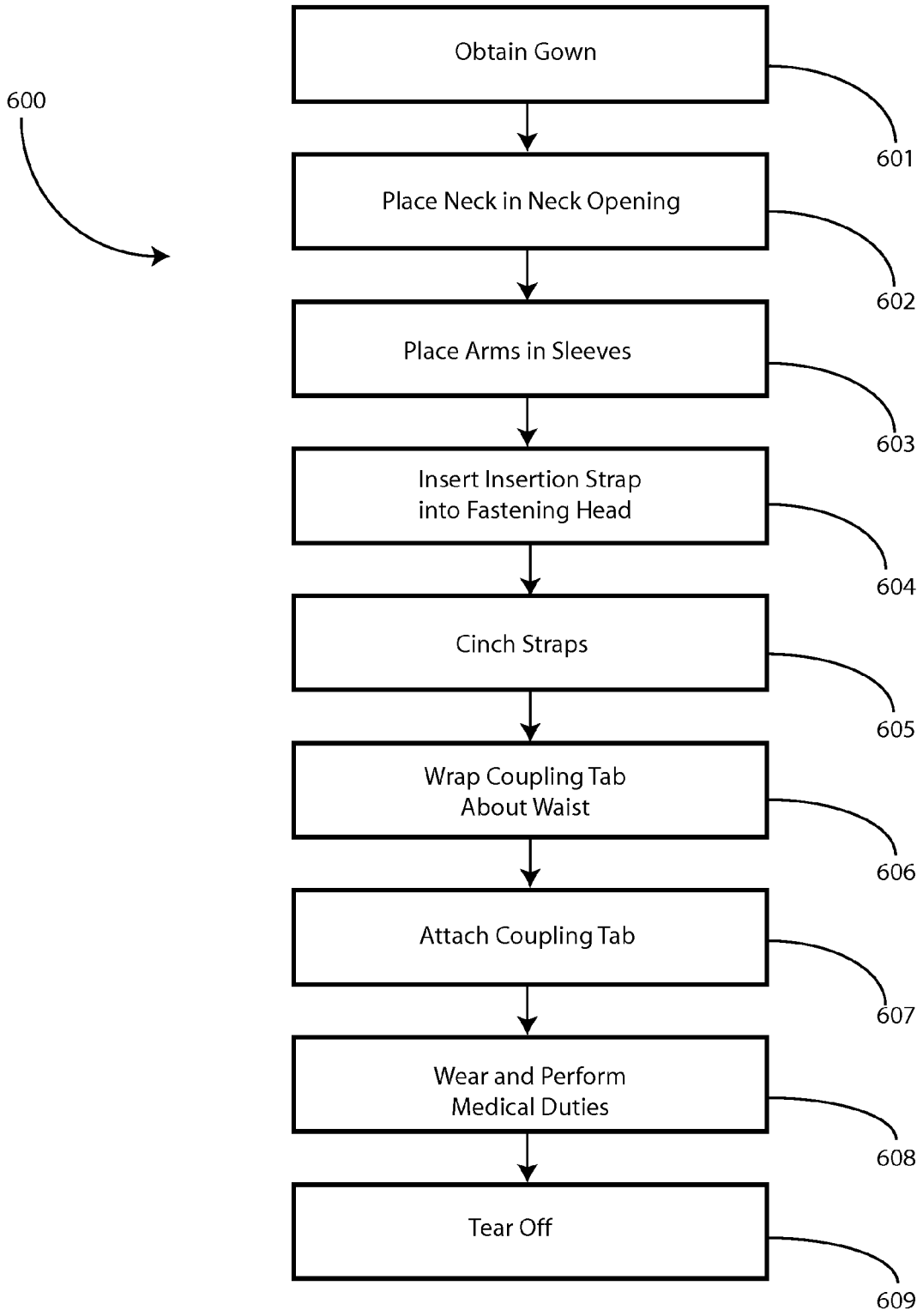
FIG. 6 illustrates one method of donning a medical gown in accordance with embodiments of the invention.

Turning now to FIG. 6, illustrated therein is one exemplary method 600 for donning a medical gown (100) in accordance with embodiments of the invention. At step 601, a wearer obtains or accesses a medical gown configured in accordance with embodiments of the invention. As described above, in one embodiment the medical gown will be manufactured from a non-woven fabric layer defining a body opening and a neck opening. In one embodiment, the medical gown includes an insertion strap coupled to the non-woven fabric layer adjacent to a first side of the neck opening and a coupling strap coupled to the non-woven fabric layer adjacent to a second side of the neck opening, with at least a portion of the non-woven fabric layer separating the coupling strap from the insertion strap.

In one embodiment, the medical gown will be preconfigured with the insertion strap engaging a fastening head of the coupling strap. In such an embodiment, the wearer will pass their head through the neck opening such that the preconfigured straps pass behind the head to place the neck within the neck opening at step 602. Once inserted, the combination of the non-woven fabric layer, the insertion strap, and the coupling strap will encircle the wearer's neck.

Where the medical gown is not preconfigured, the wearer places the neck in the neck opening at step 602, and inserts the insertion strap 109 into the fastening head 111 at optional step 604.

Figure 7:
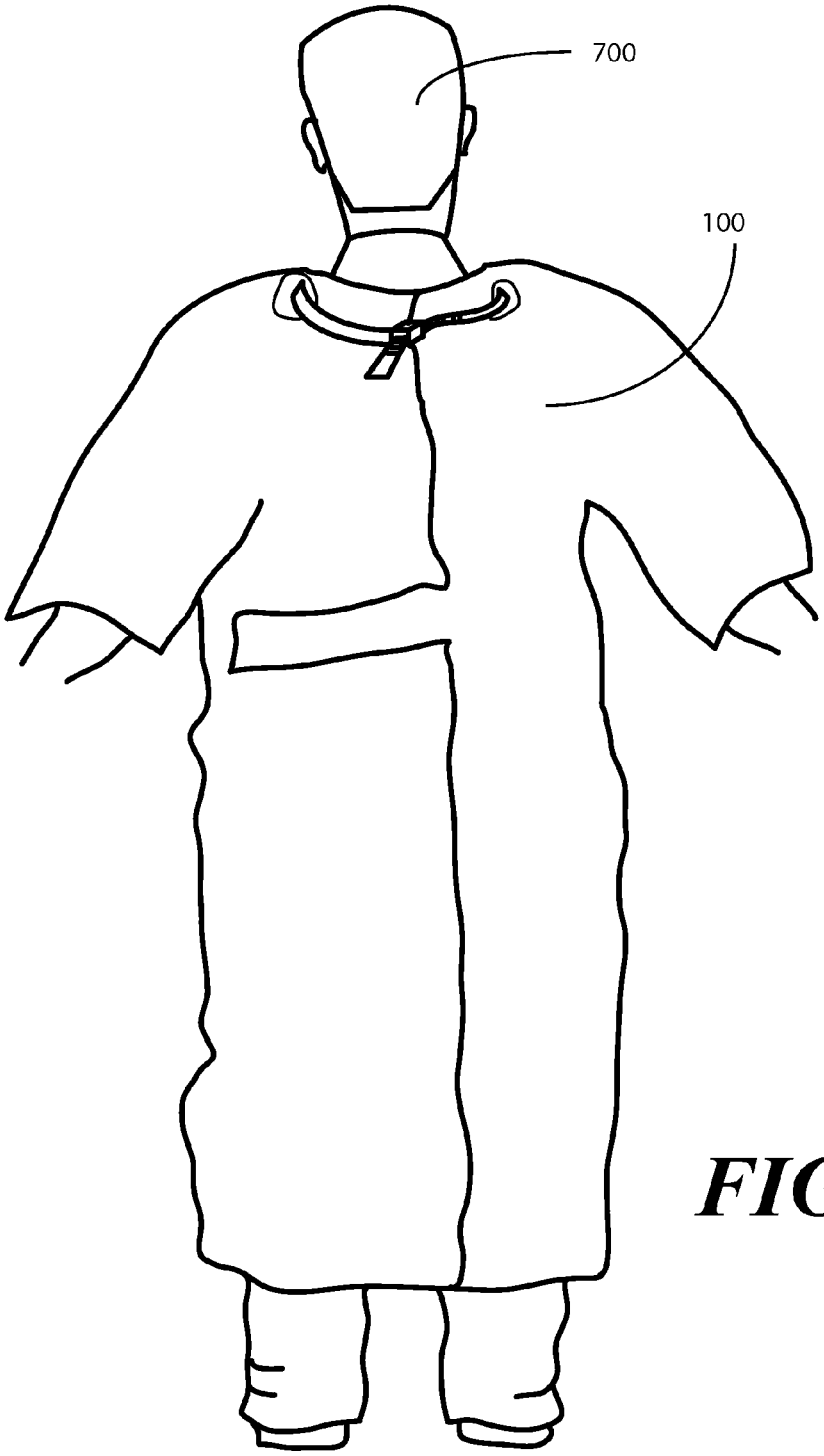
FIG. 7 illustrates a wearer wearing one medical gown in accordance with embodiments of the invention.

At step 603, the wearer places their arms into the sleeves of the medical gown. The wearer can then cinch the straps, as described in FIG. 5, at step 605 by pulling the insertion strap through a fastening head of the coupling strap to cinch the neck opening about a neck.

Where a coupling tab is provided with the medical gown, the wearer may move the coupling tab about their torso at step 606 such that the coupling tab spans the body opening. The coupling tab can then be affixed to the other side of the body opening at step 607. Turning briefly to FIG. 7, a wearer 700 is shown wearing a medical gown 100 in accordance with the steps of FIG. 6. The gown is worn for whatever medical practices are necessary at step 608.

At step 609, in one embodiment, the wearer removes the medical gown by tearing the non-woven material. In one embodiment, this step 609 may include selectively detaching the insertion strap and fastening strap from the non-woven material as well.

Figure 8:
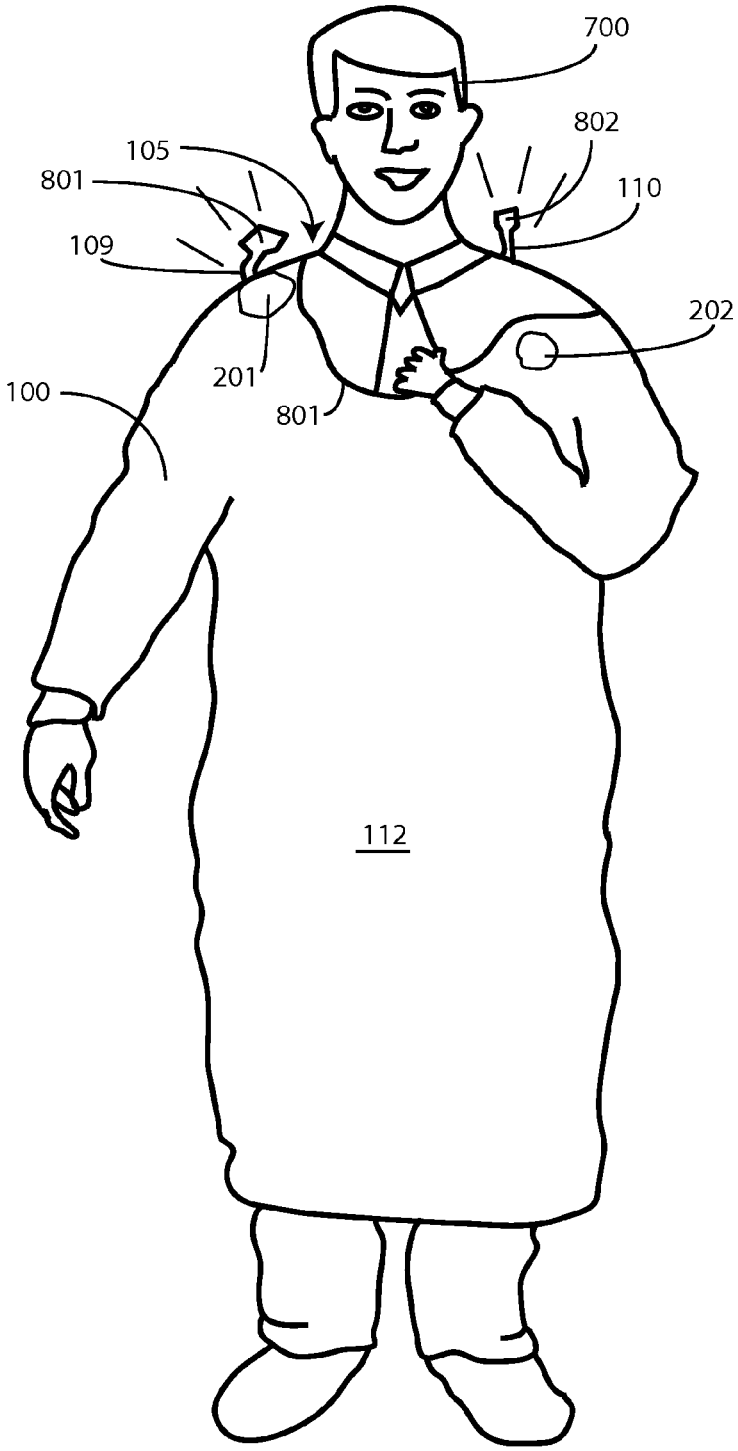
FIG. 8 illustrates a wearer removing a medical down by pulling in accordance with embodiments of the invention.

Turning briefly to FIG. 8, illustrated therein is the wearer 700 removing the medical gown 100 by pulling on the neckline 801. When the user pulls on the neckline 801, connecting tabs 802 and 803 separate from a first adhesive patch 201 and second adhesive patch 202. This causes the insertion strap 109 and the fastening strap 110 to separate from the medical gown 100, thereby allowing the wearer 700 to exit through the body opening (104). In the illustrative embodiment of FIG. 8, the wearer 700 is simply pulling the medical gown 100 off by pulling it forward such that it separates at the body opening (104) and passes about the wearer's sides. Alternatively, the wearer 700 could remove it in other ways, such as by removing the arms from the sleeves and taking the medical gown 100 off in a more conventional manner. The medical gown 100 can then be disposed of in accordance with proper biowaste procedures.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims.

What is claimed is:

1. A medical gown, comprising:

a body covering portion defining a body opening running a length of the body covering portion and terminating at a neck opening, the body opening having a first side and a second side and being configured to permit a wearer to don the medical gown;

sleeves extending distally from the body covering portion;

an insertion strap coupled to and extending from one of the first side or the second side, the insertion strap comprising a plurality of teeth disposed therealong; and a fastening strap coupled to and extending from another of the first side or the second side, the fastening strap comprising a fastening head through which the insertion strap may pass, the fastening head comprising a latch configured to engage one or more of the plurality of teeth so as to prevent the insertion strap, once inserted into the fastening head, from being withdrawn from the fastening head;

wherein a perimeter portion of the neck opening separates the insertion strap and the fastening strap and wherein the perimeter portion is configured to be easily torn by a wearer.

2. The medical gown of claim 1, wherein the insertion strap and the fastening strap are disposed adjacent to the neck opening.

3. The medical gown of claim 2, wherein the insertion strap and the fastening strap are configured to pass about a wearer's neck when the insertion strap is inserted into the fastening head.

4. The medical gown of claim 1, wherein the perimeter portion comprises a non-woven material.

5. The medical gown of claim 1, wherein the insertion strap and the fastening strap are each configured to be selectively separable from the medical gown.

6. The medical gown of claim 5, wherein the insertion strap and the fastening strap are each coupled to the medical gown with a detachable adhesive.

7. The medical gown of claim 1, further comprising a coupling tab extending from the one of the first side or the second side, the coupling tab being configured to span the body opening and adhesively adhere to another of the first side or the second side.

8. The medical gown of claim 7, wherein the coupling tab is configured to be tearable by the wearer.

9. The medical gown of claim 7, wherein the coupling tab comprises an adhesive configured to be selectively detachable from the body covering portion when adhered to the body covering portion.

10. The medical gown of claim 1, wherein the body covering portion is configured to extend from a wearer's shoulder to below the wearer's knee.

11. The medical gown of claim 1, wherein the medical gown is preconfigured with the insertion strap at least partially inserted into the fastening head.

12. The medical gown of claim 1, wherein the sleeves are disposed along a front portion of the body covering portion, further wherein the body opening is defined in a rear portion of the body covering portion.

13. A medical gown comprising:

a non-woven fabric layer defining a body opening running substantially a length of the medical gown into a neck opening;

an insertion strap coupled to the non-woven fabric layer adjacent to a first side of the neck opening; and a coupling strap coupled to the non-woven fabric layer adjacent to a second side of the neck opening, with at least a portion of the non-woven fabric layer separating the coupling strap from the insertion strap;

wherein the at least the portion of the non-woven fabric layer is configured to be torn by a wearer; and wherein the medical gown is preconfigured with the insertion strap at least partially inserted into a fastening head of the coupling strap.

14. The medical gown of claim 13, further comprising a coupling tab extending from one side of the body opening, the coupling tab having a strap length configured to span at least the body opening, wherein the coupling tab comprises an adhesive configured to selectively adhere the non-woven fabric layer.

15. A method of donning a medical gown, comprising:

accessing the medical gown, the medical gown comprising:

a non-woven fabric layer defining a body opening and a neck opening;

an insertion strap coupled to the non-woven fabric layer adjacent to a first side of the neck opening; and a coupling strap coupled to the non-woven fabric layer adjacent to a second side of the neck opening, with at least a portion of the non-woven fabric layer separating the coupling strap from the insertion strap;

wherein the medical gown is preconfigured with the insertion strap engaging a fastening head of the coupling strap;

passing a head through the neck opening, such that a combination of the non-woven fabric layer, the insertion strap, and the coupling strap encircle a neck; and pulling the insertion strap through the fastening head of the coupling strap to cinch the neck opening about the neck.

16. The method of claim 15, further comprising moving a coupling tab extending from the non-woven fabric layer about a wearer and across the body opening and adhesively attaching the coupling tab to the non-woven fabric layer.

17. The method of claim 15, further comprising tearing the non-woven fabric layer to remove the medical gown.

18. A medical gown, comprising:

a body covering portion defining a body opening running a length of the body covering portion and terminating at a neck opening, the body opening having a first side and a second side and being configured to permit a wearer to don the medical gown;

sleeves extending distally from the body covering portion;

an insertion strap comprising a body portion having faces on either side thereof and coupled to and extending from one of the first side or the second side, the insertion strap comprising one of a series of teeth forming ramps along one or more faces of the insertion strap or a series of indentations formed along one or more faces of the insertion strap; and a fastening strap coupled to and extending from another of the first side or the second side, the fastening strap comprising a fastening head through which the insertion strap may pass, the fastening head comprising a latch configured to engage one or more of the series of teeth or the series of indentations so as to prevent the insertion strap, once inserted into the fastening head, from being withdrawn from the fastening head.

* * * * *